US010565965B2

(12) United States Patent
Yi et al.

(10) Patent No.: US 10,565,965 B2
(45) Date of Patent: Feb. 18, 2020

(54) METHOD AND DEVICE FOR CONTROLLING REFRESH RATE OF MOBILE TERMINAL AND MOBILE TERMINAL

(71) Applicant: GUANGDONG OPPO MOBILE TELECOMMUNICATIONS CORP., LTD., Dongguan (CN)

(72) Inventors: Yongpeng Yi, Dongguan (CN); Deliang Peng, Dongguan (CN); Shengjun Gou, Dongguan (CN); Xiaori Yuan, Dongguan (CN); Gaoting Gan, Dongguan (CN); Zhiyong Zheng, Dongguan (CN); Hai Yang, Dongguan (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 0 days.

(21) Appl. No.: 15/799,564

(22) Filed: Oct. 31, 2017

(65) Prior Publication Data

US 2018/0261191 A1 Sep. 13, 2018

(30) Foreign Application Priority Data

Mar. 10, 2017 (CN) ..... 2017 1 0142872

(51) Int. Cl.
*G09G 5/395* (2006.01)
*G09G 5/393* (2006.01)
(Continued)

(52) U.S. Cl.
CPC ..... *G09G 5/393* (2013.01); *G09G 3/3611* (2013.01); *G09G 5/12* (2013.01); *G09G 5/395* (2013.01);
(Continued)

(58) Field of Classification Search
None
See application file for complete search history.

(56) References Cited

U.S. PATENT DOCUMENTS

2005/0138077 A1* 6/2005 Michael ..... G06Q 30/02
2008/0100598 A1 5/2008 Juenger
(Continued)

FOREIGN PATENT DOCUMENTS

CN 102930852 A 2/2013
CN 102968978 A 3/2013
(Continued)

OTHER PUBLICATIONS

PCT/CN2017/109979 English translation of International Search Report and Written Opinion dated Jan. 25, 2018, 12 pages.
(Continued)

*Primary Examiner* — Joni Richer
(74) *Attorney, Agent, or Firm* — Lathrop GPM LLP

(57) ABSTRACT

Embodiments of the present disclosure provide a method and a device for controlling a refresh rate of a mobile terminal and a mobile terminal. The method includes: determining that each of at least one foreground applications running currently is in a whitelist consisting of preset applications; obtaining a preset refresh rate corresponding to each of the at least one foreground application in the whitelist, and determining a target refresh rate of a display screen of the mobile terminal according to the preset refresh rate corresponding to each of the at least one foreground applications, in which an operation mode of the display screen is a command mode; and controlling the display screen by a display controller to read display frame data to be displayed from a frame buffer unit of the display screen at a frequency same as the target refresh rate and to display the display frame data.

13 Claims, 4 Drawing Sheets

(51) Int. Cl.
*G09G 3/36* (2006.01)
*G09G 5/12* (2006.01)

(52) U.S. Cl.
CPC . *G09G 2320/06* (2013.01); *G09G 2320/0613* (2013.01); *G09G 2320/103* (2013.01); *G09G 2330/022* (2013.01); *G09G 2340/0435* (2013.01); *G09G 2360/12* (2013.01); *G09G 2360/18* (2013.01)

(56) References Cited

U.S. PATENT DOCUMENTS

| | | | | |
|---|---|---|---|---|
| 2013/0141642 | A1* | 6/2013 | Wu | G06F 3/1407 348/441 |
| 2014/0267360 | A1 | 9/2014 | Finkel | |
| 2015/0261284 | A1* | 9/2015 | Lee | G06F 1/3234 713/323 |
| 2015/0331836 | A9 | 11/2015 | Geelnard | |
| 2016/0187949 | A1* | 6/2016 | Sen | H04W 52/028 713/310 |

FOREIGN PATENT DOCUMENTS

| | | | |
|---|---|---|---|
| CN | 103513748 | A | 1/2014 |
| CN | 104091579 | A | 10/2014 |
| CN | 104731543 | A | 6/2015 |
| CN | 105009194 | A | 10/2015 |
| CN | 106791212 | A | 5/2017 |
| CN | 106941563 | A | 7/2017 |

OTHER PUBLICATIONS

European Patent Application 17198470.1 extended Search and Opinion dated Mar. 23, 2018, 15 pages.
Chinese Patent Application 201710142872.5 English translation of Office Action dated Mar. 5, 2019, 11 pages.
Chinese Patent Application 201710142872.5 Office Action dated Mar. 5, 2019, 10 pages.

* cited by examiner

METHOD AND DEVICE FOR CONTROLLING REFRESH RATE OF MOBILE TERMINAL AND MOBILE TERMINAL

CROSS-REFERENCE TO RELATED APPLICATIONS

The application claims priority to and benefits of Chinese Patent Application Serial No. 201710142872.5, filed with the State Intellectual Property Office of P.R. China on Mar. 10, 2017, the entire content of which is incorporated herein by reference.

TECHNICAL FIELD

Embodiments of the present disclosure generally relates to mobile terminal technical field, and more particularly, to a method and a device for controlling a refresh rate of a mobile terminal and a mobile terminal.

BACKGROUND

With the development of mobile terminal technology, various mobile terminals have become an indispensable tool for people's lives and work. For the mobile terminal installed with an operating system, the mobile terminal presents various display frames at different times by constantly refreshing the display frames.

In a display refresh process in the mobile terminal such as a mobile phone, there are a render operation, a composition operation and a display operation. Each application, such as a desktop or a video, performs the render operation to draw a respective image separately. After all the applications have finished the render operation, the system performs the composition operation to compose the images drawn by respective applications into one display frame. The display frame is output to a screen for displaying finally. There is a need to improve the method for controlling a refresh rate of the mobile terminal in the refresh operation.

SUMMARY

Embodiments of the present disclosure provide a method and a device for controlling a refresh rate of a mobile terminal and a mobile terminal, which may control a refresh rate of a display screen of the mobile terminal reasonably.

According to a first aspect, embodiments of the present disclosure provide a method for controlling a refresh rate of a mobile terminal, including:

- determining that each of at least one foreground applications running currently is in a whitelist including preset applications;
- obtaining a preset refresh rate corresponding to each of the at least one foreground applications in the whitelist, and determining a target refresh rate of a display screen of the mobile terminal according to the preset refresh rate corresponding to each of the at least one foreground applications, in which an operation mode of the display screen is a command mode; and
- controlling the display screen through a display controller to read display frame data to be displayed from a frame buffer unit of the display screen at a frequency same as the target refresh rate and to display the display frame data.

According to a second aspect, embodiments of the present disclosure provide a device for controlling a refresh rate of a mobile terminal, including a non-transitory computer-readable medium including computer-executable instructions stored thereon and an instruction execution system configured by the instructions to implement at least one of:

- an application determining module, configured to determine that each of at least one foreground applications running currently is in a whitelist including preset applications;
- a first target refresh rate determining module, configured to obtain a preset refresh rate corresponding to each of the at least one foreground applications in the whitelist, and to determine a target refresh rate of a display screen of the mobile terminal according to the preset refresh rate corresponding to each of the at least one foreground applications, in which an operation mode of the display screen is a command mode; and
- a data displaying module, configured to control the display screen by a display controller to read display frame data to be displayed from a frame buffer unit of the display screen at a frequency same as the target refresh rate and to display the display frame data.

According to a third aspect, embodiments of the present disclosure provide a mobile terminal, including a memory, a processor, a display screen and a display controller. The display screen has a frame buffer unit. The memory is configured to store executable program codes. The processor is configured to run a program corresponding to executable program codes by reading the executable program codes stored in the memory, to perform the following operations: determining that each of at least one foreground applications running currently is in a whitelist including preset applications; obtaining a preset refresh rate corresponding to each of the at least one foreground applications in the whitelist, and determining a target refresh rate of a display screen of the mobile terminal according to the preset refresh rate corresponding to each of the at least one foreground applications, in which an operation mode of the display screen is a command mode. The display controller is configured to control the display screen to read display frame data to be displayed from the frame buffer unit of the display screen at a frequency same as the target refresh rate and to display the display frame data.

With the embodiments of the present disclosure, the refresh rate of the display screen of the mobile terminal may be controlled reasonably.

DETAILED DESCRIPTION

Figure 1:
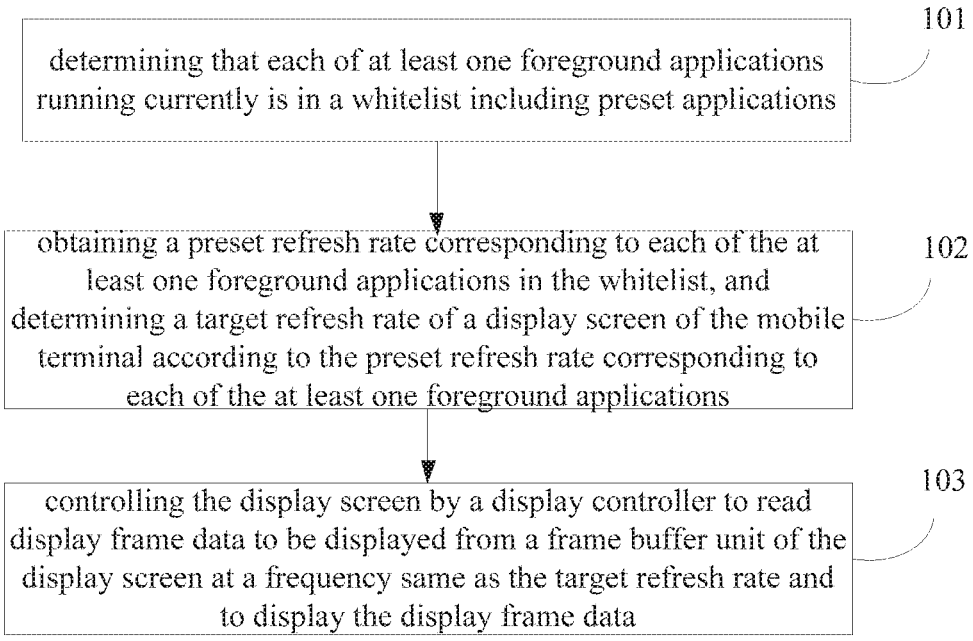
FIG. 1 is a flow chart of a method for controlling a refresh rate of a mobile terminal according to an embodiment of the present disclosure.

In order to make objectives, technical solutions and advantages of the present disclosure clearer, the specific embodiments of the present disclosure will be described in detail with reference to the accompanying drawings as follows. It is to be understood that the specific embodiments described herein should be for the purpose of explaining the present disclosure and shall not be construed to limit the present disclosure. In addition, it is to be noted that, for the sake of convenience of description, only the parts related to the present disclosure are illustrated in the drawings, but not all. Before discussing the exemplary embodiments in more detail, it should be noted that some exemplary embodiments are described as processes or methods depicted in the flow charts. Although the flow charts describe the operations (or steps) as sequential processing, many of these operations may be implemented concurrently, concomitantly or simultaneously. In addition, the order of operations can be rearranged. The process may be terminated when its operation is complete, but may also have additional steps not included in the drawings. The process may correspond to methods, functions, procedures, subroutines, subprograms, and the like.

FIG. 1 provides a flow chart of a method for controlling a refresh rate of a mobile terminal according to an embodiment of the present disclosure. The method of the embodiment may be performed by a device for controlling a refresh rate of a mobile terminal. The device may be implemented by hardware and/or software, which may be provided as a part of the mobile terminal and arranged in the mobile terminal.

As illustrated in FIG. 1, the method for controlling a refresh rate of a mobile terminal provided in the embodiment of the present disclosure includes the following.

At block 101, it is determined that each of at least one foreground applications running currently is a preset application in a whitelist.

Figure 2:
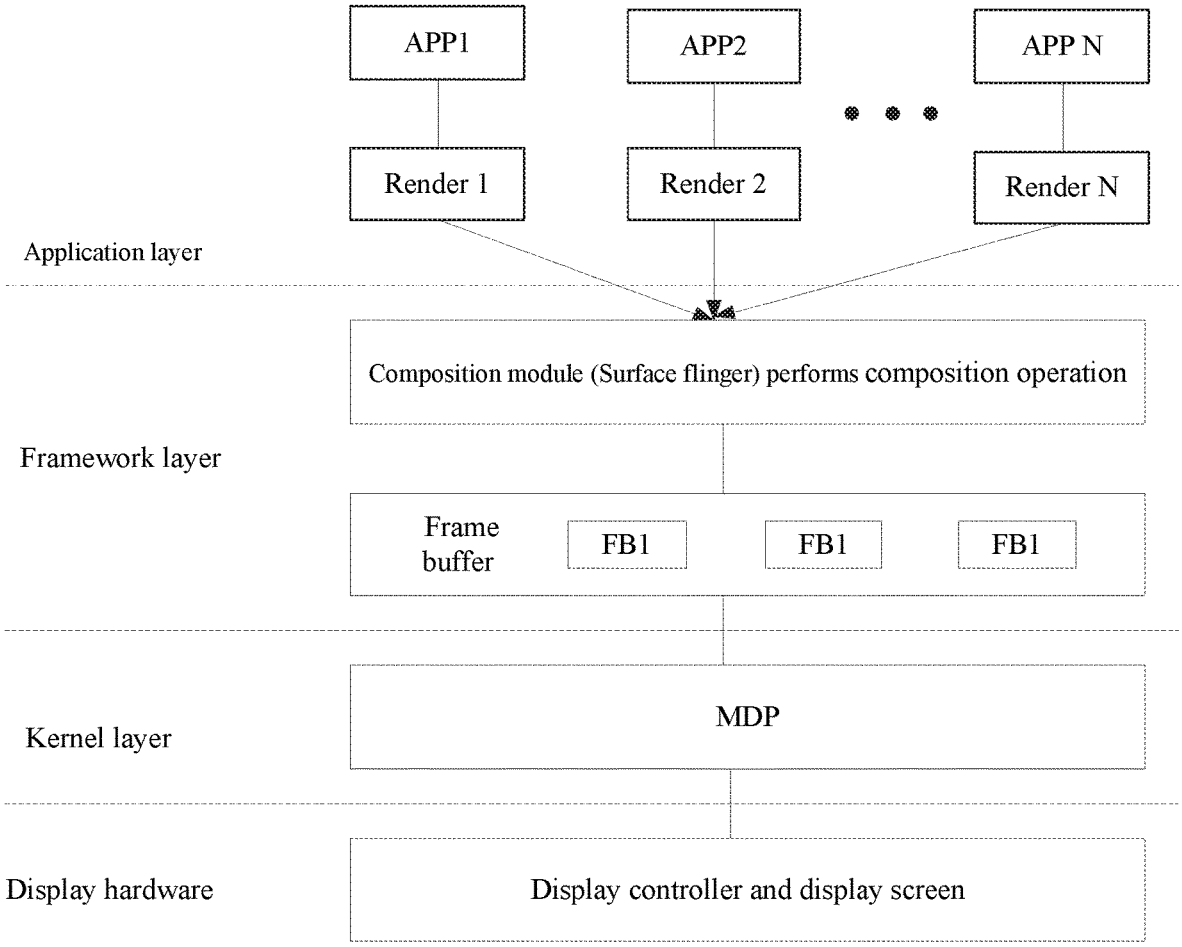
FIG. 2 is a schematic diagram illustrating a display process according to an embodiment of the present disclosure.

In order to facilitate understanding, an Android system is taken as an example in the following. A display frame in the Android system is described simply from generation to display. FIG. 2 is a schematic diagram illustrating a display process according to an embodiment of the present disclosure.

First, in an application layer, each application program (hereinafter referred to as application or APP) performs an image render operation separately according to its own application design (which is generally determined by an Android package (APK for short)). When the image render operation is finished, each application sends all images drawn to a composition module (Surface Flinger) for performing an image composition operation.

Then, in a framework layer, there are three frame buffers (FBs for short). The three FBs can be reused. The Surface Flinger finds an idle one from the three FBs, and in the idle FB, superimposes the plurality of images drawn by respective applications together through the image composition operation according to application configuration information, such as which image should be set at bottom, which image should be set at top, which image should be transparent and the like, so as to obtain a display frame to be displayed (a picture to be displayed).

Finally, in a kernel layer, a mobile display process (MDP for short) module of the mobile terminal may control the BF to transmit the display frame to be displayed to a display hardware (which includes a display controller and a display screen), such that the display frame to be displayed may be displayed in the display screen finally. The display screen is not limited herein, for example, may be a liquid crystal display (LCD for short)). Generally, the display screen of the mobile terminal performs the refresh at a maximum refresh rate, for example, 60 Hz.

Figure 3:
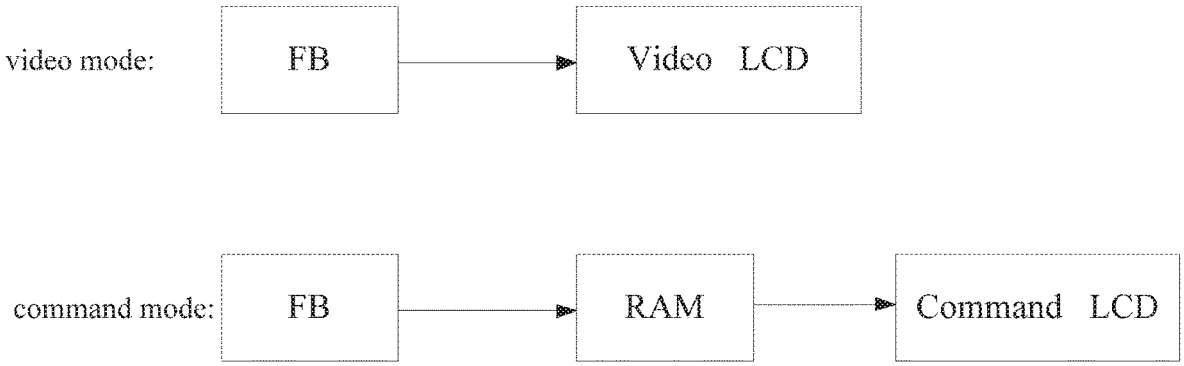
FIG. 3 is a schematic diagram illustrating display data transmission of a display screen under a video mode and a command mode according to an embodiment of the present disclosure.

There are two operation modes of the display screen: a video mode and a command mode. The video mode is also called DSI mode, and the command mode is also called DCS mode. FIG. 3 illustrates display data transmission of the display screen under the video mode and the command mode. As illustrated in FIG. 3, the following may be described.

The video mode is mainly for the refresh operation under display architecture that there is no frame buffer unit (for example RAM) in the display screen. A main controller of the mobile terminal needs to refresh the display screen continuously. Since dedicated synchronization information for transmitting data and signals is not used, control signals and RGB image data are transmitted in a form of message via a Mobile Industry Processor Interface (MIPI for short) bus. Since the host needs to refresh the display screen periodically, the display screen does not require the frame buffer unit. The host controls the FB to send the display frame data to be displayed to the display screen (for example, LCD) at the frequency same as the refresh rate of the display screen.

The command mode is mainly for the refresh operation under display architecture that there is the frame buffer unit (for example, RAM) in the display screen. The main controller only needs to send the data to be displayed in the BF to the frame buffer unit (for example, RAM) in the display screen when the display picture needs to be updated, and the display controller controls the display screen to read the data from the frame buffer unit (for example, RAM) for display at other time. Under the command mode, a MIPI bus controller uses a display command message to send image data to the display screen. The frame buffer unit in the display screen stores all the image data. Once the image data is placed in the frame buffer unit of the display screen, the display controller controls the display screen to fetch data from the frame buffer unit and automatically display it on the display screen. The MIPI bus controller does not need to refresh the display screen periodically.

The method for controlling the refresh rate provided in the embodiment of the present disclosure is for the display screen under the command mode.

During processes of the image render, the image composition and the refresh display in the mobile terminal, there are three kinds of frame rates: a render frame rate, a composition frame rate and a refresh rate.

The render frame rate may be one at which the application renders the image and triggers the Surface flinger to perform composition, and should be understood as the number of times for drawing the images by the application in a unit time (for example, 1 second).

The composition frame rate may be one at which the images drawn by respective applications are composited into a display frame (picture) to be displayed.

The refresh rate may be a frame rate at which the display screen of the mobile terminal refreshes the display frames.

The method for controlling the refresh rate provided in the embodiment of the present disclosure mainly relates to the refresh display operation in the above-described display processes of the display frame to be displayed.

In this block, the whitelist prestores the preset applications that need to reduce the frame rates and the preset refresh rates corresponding to the preset applications. In detail, the whitelist prestores a correspondence relationship between application identifiers of the preset applications and the corresponding preset refresh rates. In general, the display screen of the mobile terminal may perform the refresh at a refresh rate of 60 HZ. However, some applications, for example, video-type applications, reader-type applications, or social type applications such as WeChat and QQ, do not need such high refresh rate to meet requirements of natural and smooth display frames. Therefore, these applications and their preset refresh rates may be stored into the whitelist in advance. When it is detected that the mobile terminal runs the application in the whitelist, the target refresh rate of the display screen of the mobile terminal may be set according to the preset refresh rate. The preset refresh rate corresponding to the application may be a minimum refresh rate of the display screen when the application meets the natural and smooth display frames, which is determined according to experimental data.

The block may include the following. The foreground application running currently is detected to obtain an application identifier of the foreground application, and it is determined that the foreground application is a preset application in the whitelist when the application identifier is found in the whitelist.

At block 102, a preset refresh rate corresponding to each of the at least one foreground applications is obtained in the whitelist, and a target refresh rate of a display screen of the mobile terminal is determined according to the preset refresh rate corresponding to each of the at least one foreground applications, in which an operation mode of the display screen is a command mode.

The preset refresh rate corresponding to the foreground application may be obtained from the whitelist as follows. The preset refresh rate corresponding to the application identifier is obtained from the whitelist according to the application identifier of the foreground application.

There may be one or more foreground applications running currently. When there is one foreground application, the target refresh rate of the display screen may be determined as the preset refresh rate corresponding to this foreground application. When there are a plurality of foreground applications, the target refresh rate of the display screen may be determined according to respective application attributes and respective preset refresh rates of the plurality of foreground applications, in which the application attribute if each ground application includes an application priority or an application type.

In detail, the preset refresh rate corresponding to the foreground application with the highest priority or with a preset application type may be determined as the target refresh rate of the display screen.

For example, when there are two applications and the application priority of application 1 is higher than that of application 2, it may be determined that the target refresh rate of the display screen is the preset refresh rate corresponding to application 1. For example, when there are two foreground applications, the application type of application 3 is video and the application type of application 4 is reader, it may be determined that the target refresh rate of the display screen is the preset refresh rate corresponding to application 3.

This block may include: obtaining the preset refresh rate corresponding to each of the at least one foreground applications in the whitelist and a current performance parameter of the mobile terminal, in which the performance parameter includes at least one of an electric quantity, a occupied memory and temperature of the mobile terminal, a frequency of a central processor, a load of the central processer, a frequency of an image processor and a load of the image processor; and determining the target refresh rate of the display screen according to the preset refresh rate corresponding to each of the at least one foreground applications and the current performance parameter of the mobile terminal.

For example, when the performance parameter is the electric quantity of the mobile terminal, the target refresh rate of the display screen may be determined as follows. When a ratio of the current electric quantity to a preset maximum electric quantity is greater than or equal to a first preset ratio, the target refresh rate of the display screen is determined based on the preset refresh rate corresponding to each of the at least one foreground applications, in which the first preset ratio is less than 1. When the ratio of the current electric quantity to the preset maximum electric quantity is less than the first preset ratio, the target refresh rate of the display screen is determined based on a first preset percentage value and the preset refresh rate corresponding to each of the at least one foreground application, in which the first preset percentage value is less than 1. The first preset ratio may be 50% and the first preset percentage value may be 80%.

In detail, when the ratio of the current electric quantity to the preset maximum electric quantity is greater than or equal to the first preset ratio, the target refresh rate of the display screen may be determined as follows. When there is only one foreground application, the target refresh rate of the display screen is determined as the preset refresh rate corresponding to the foreground application. When there are more than one foreground applications, an intermediate refresh rate of the display screen is determined according to the respective application attributes and the respective preset refresh rates of the foreground applications, and the target refresh rate of the display screen is determined as the intermediate refresh rate.

In detail, when the ratio of the current electric quantity to the preset maximum electric quantity is less than the first preset ratio, the target refresh rate of the display screen may be determined as follows. When there is only one foreground application, the target refresh rate of the display screen is determined as the first preset percentage value of the preset refresh rate corresponding to this foreground application. When there are more than one foreground applications, an intermediate refresh rate of the display screen is determined according to the respective application attributes and the respective preset refresh rates of the foreground applications, and the target refresh rate of the display screen is determined as the first preset percentage value of the intermediate refresh rate.

For example, when the performance parameter is the occupied memory of the mobile terminal, the temperature of the mobile terminal, the frequency of the central processor, the load of the central processer, the frequency of the image processor or the load of the image processor, the target refresh rate of the display screen may be determined as follows. When a ratio of the current performance parameter value to a corresponding preset maximum performance parameter value is greater than or equal to a second preset ratio, the target refresh rate of the display screen is determined based on a second preset percentage value and the preset refresh rate corresponding to each of the at least one foreground applications, in which the second preset ratio is less than 1 and the second preset percentage value is less than 1. When the ratio of the current performance parameter value to the corresponding preset maximum performance parameter value is less than the second preset ratio, the target refresh rate of the display screen is determined based on the preset refresh rate corresponding to each of the at least one foreground applications. The second preset ratio may be 50% and the second preset percentage value may be 80%.

In detail, when the ratio of the current performance parameter value to the corresponding preset maximum performance parameter value is greater than or equal to the second preset ratio, the target refresh rate of the display screen may be determined as follows. When there is only one foreground application, the target refresh rate of the display screen is determined as the second preset percentage value of the preset refresh rate corresponding to this foreground application. When there are more than one foreground applications, an intermediate refresh rate of the display screen is determined according to the respective application attributes and the respective preset refresh rates of the foreground applications, and the target refresh rate of the display screen is determined as the second preset percentage value of the intermediate refresh rate.

In detail, when the ratio of the current performance parameter value to the corresponding preset maximum performance parameter value is less than the second preset ratio, the target refresh rate of the display screen may be determined as follows. When there is only one foreground application, the target refresh rate of the display screen is determined as the preset refresh rate corresponding to this foreground application. When there are more than one foreground applications, an intermediate refresh rate of the display screen is determined according to the respective application attributes and the respective preset refresh rates of the foreground applications, and the target refresh rate of the display screen is determined as the intermediate refresh rate.

It is to be noted that the target refresh rate of the display screen can be determined based on the preset refresh rates corresponding to the foreground applications in combination with several of the above performance parameters.

The method provided by the embodiment may further include: when a render frame rate of the foreground application is greater than the target refresh rate, setting the render frame rate of the foreground application to be same as the target refresh rate. The advantage of this setting is that the frequency of the render operation of the application is less than or equal to the refresh rate of the display screen, thus avoiding unnecessary power consumption caused by occupying resources of the mobile terminal when the image drawn by the application cannot be updated.

At block 103, the display screen is controlled by a display controller to read display frame data to be displayed from a frame buffer unit of the display screen at a frequency same as the target refresh rate and to display the display frame data.

After the target refresh rate of the display screen is determined, the display controller controls the display screen to read the display frame data to be displayed from the frame buffer unit of the display screen at the frequency of the target refresh rate and display the read data. Compared with performing the refresh operation at a fixed maximum refresh rate in the related art, power consumption of the display screen of the mobile terminal may be reduced.

The method may further include: when it is detected that any one of the at least one foreground applications running currently is not in the whitelist, determining the target refresh rate of the display screen as a second preset value. The second preset value may be a maximum refresh rate of 60 Hz for the display screen. For applications that are not in the whitelist such as games, these applications require the high refresh rate and refresh can be performed at the maximum refresh rate.

With the method for controlling a refresh rate of a mobile terminal according to the embodiments of the present disclosure, the foreground application running currently is detected, when the foreground application is in the whitelist, the preset refresh rate corresponding to the foreground application in the whitelist is obtained, the target refresh rate of the display screen of the mobile terminal is determined according to the preset refresh rate corresponding to the foreground application, in which the operation mode of the display screen is the command mode, and the display screen is controlled by the display controller to read the display frame data to be displayed from the frame buffer unit of the display screen at the same frequency as the target refresh rate and to display the display frame data, which may control the refresh rate of the display screen of the mobile terminal reasonably.

Figure 4:
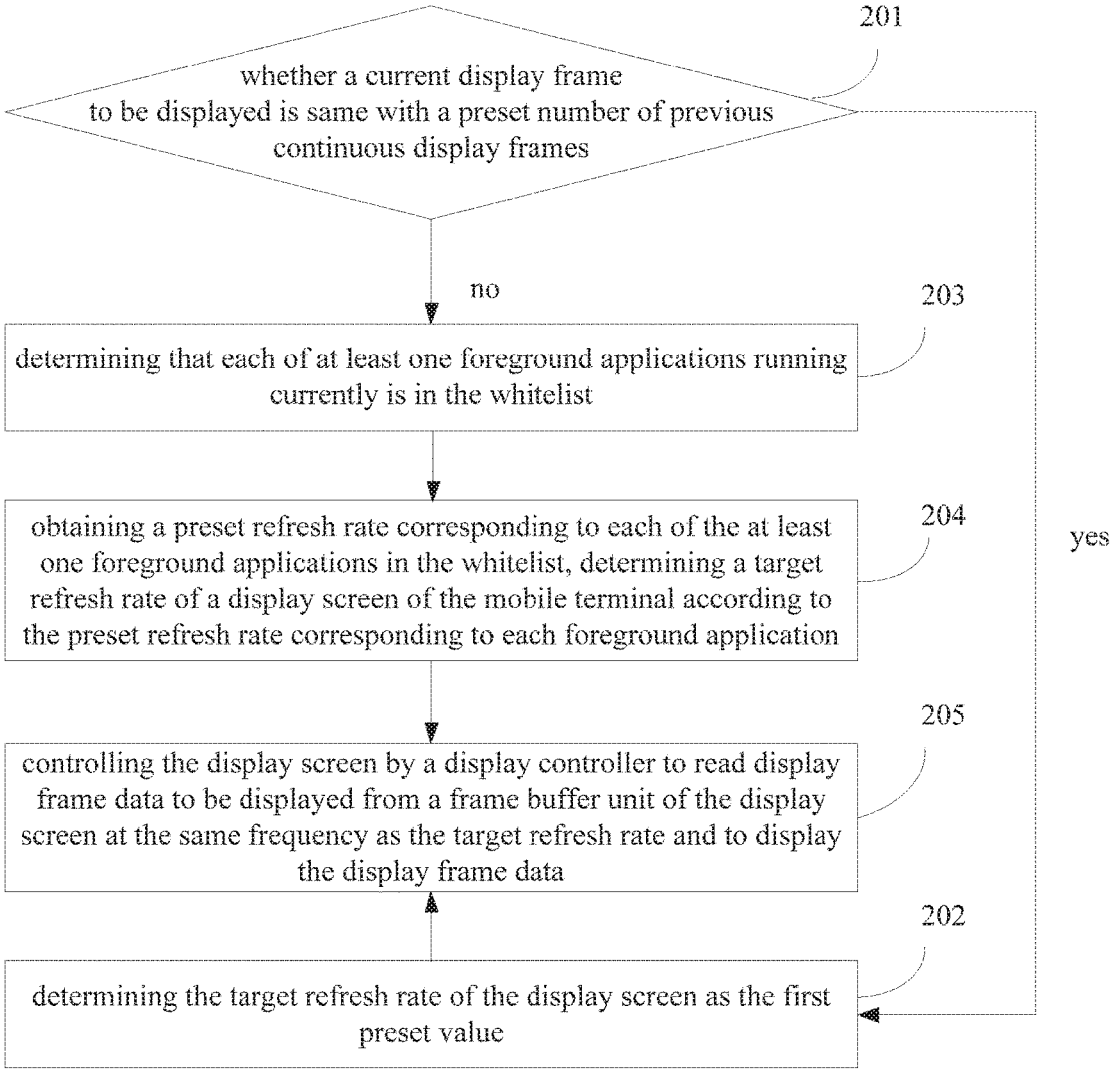
FIG. 4 is a flow chart of a method for controlling a refresh rate of a mobile terminal according to an embodiment of the present disclosure.

FIG. 4 provides a flow chart of a method for controlling a refresh rate of a mobile terminal according to an embodiment of the present disclosure. As illustrated in FIG. 4, the method provided in the embodiment of the present disclosure includes the following.

At block 201, it is detected whether a current display frame to be displayed is same with a preset number of previous continuous display frames. If yes, block 202 is executed, and if not, block 203 is executed.

This block aims to determine whether a current operation scene of the mobile terminal is a static picture scene. When the current display frame to be displayed is same with the preset number of previous continuous display frames, the current operation scene of the mobile terminal is the static picture scene. Otherwise, the current operation scene of the mobile terminal is a dynamic picture scene.

At block 202, the target refresh rate of the display screen is determined as the first preset value. The first preset value is less than a maximum refresh rate of the display screen. For example, the first preset value may be 30 Hz or 40 Hz.

When the current display frame to be displayed is same with the preset number of previous continuous display frames, the current operation scene of the mobile terminal is the static picture scene, and the target refresh rate of the display screen may be determined as the first preset value that is less than the maximum refresh rate of the display screen. The power consumption of the mobile terminal is reduced as compared with the related art in which the power consumption of the display screen is large because the refresh of the display screen is performed at the preset maximum refresh rate regardless of the static picture scene or the dynamic picture scene.

At block 203, it is determined that each of the at least one foreground applications running currently is in the whitelist.

When the current display frame to be displayed is not same with the preset number of previous continuous display frames, the current operation scene of the mobile terminal is the dynamic picture scene, and the target refresh rate of the display screen is determined according to the application running currently. Further, it is first determined whether each of the foreground applications running currently is in the whitelist. In detail, when the current display frame to be displayed is not same with all or one of the preset number of previous continuous display frames, it is determined whether each of the foreground applications running currently is in the whitelist.

At block 204, a preset refresh rate corresponding to each of the at least one foreground applications is obtained from the whitelist, and the target refresh rate of the display screen of the mobile terminal is determined according to the preset refresh rate corresponding to each of the at least one foreground applications, in which an operation mode of the display screen is a command mode.

At block 205, the display screen is controlled by a display controller to read display frame data to be displayed from a frame buffer unit of the display screen at a frequency same as the target refresh rate and to display the display frame data.

The target refresh rate of the display screen may be determined based on the preset refresh rate of each foreground application in the whitelist and the display refresh operation may be performed at the target refresh rate.

The specific implementation of blocks 203 to 205 in the embodiment may be based on the implementation described in blocks 101 to 103 in the above embodiment, which is not be described in detail in this embodiment.

With the method provided in the embodiments of the present disclosure, a scene type where the mobile terminal is located is detected currently; when the mobile terminal is located in the static picture scene, the target refresh rate of the display screen is determined as the first preset value, and when the mobile terminal is located in the dynamic picture scene, the preset refresh rate corresponding to each foreground application is obtained in the whitelist, and the target refresh rate of the display screen of the mobile terminal is determined according to the preset refresh rate corresponding to each foreground application. The display screen is controlled by the display controller to read the display frame data to be displayed from the frame buffer unit of the display screen at the same frequency as the target refresh rate and to display the display frame date, which may control the refresh rate of the display screen of the mobile terminal reasonably.

Figure 5:
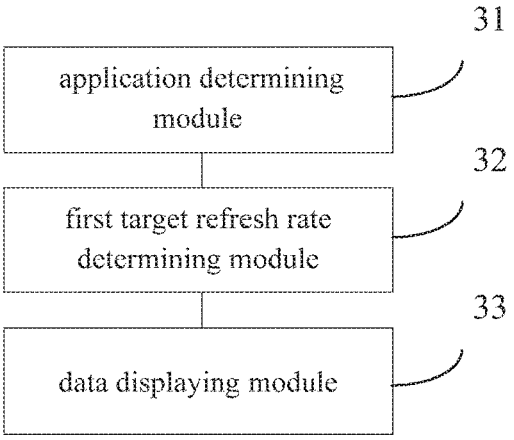
FIG. 5 is a block diagram illustrating a device for controlling a refresh rate of a mobile terminal according to an embodiment of the present disclosure.

FIG. 5 is a block diagram illustrating a device for controlling a refresh rate of a mobile terminal according to an embodiment of the present disclosure. The device may be implemented by hardware and/or software, which may be integrated in the mobile terminal. As illustrated in FIG. 5, the device includes an application determining module 31, a first target refresh rate determining module 32 and a data displaying module 33.

The application determining module 31 is configured to determine that each of at least one foreground applications running currently is in a whitelist including preset applications.

The first target refresh rate determining module 32 is configured to obtain a preset refresh rate corresponding to each of the at least one foreground applications in the whitelist, and to determine a target refresh rate of a display screen of the mobile terminal according to the preset refresh rate corresponding to each of the at least one foreground applications, in which an operation mode of the display screen is a command mode.

The data displaying module 33 is configured to control the display screen by a display controller to read display frame data to be displayed from a frame buffer unit of the display screen at the same frequency as the target refresh rate and to display the display frame data.

Further, the application determining module 31 is configured to: detect whether a current display frame to be displayed of the foreground application is same with a preset number of previous continuous display frames; and when it is detected that the current display frame to be displayed is not same with the preset number of previous continuous display frames, determine that the foreground application running currently is in the whitelist.

Further, the device further includes a second target refresh rate determining module. The second target refresh rate determining module is configured to determine the target refresh rate of the display screen as a first preset value when it is detected that the current display frame to be displayed is same with the preset number of previous continuous display frames, in which the first preset value is less than a preset maximum refresh rate of the display screen.

Further, when there is one foreground application, the first target refresh rate determining module is configured to determine the target refresh rate of the display screen as the preset refresh rate corresponding to the foreground application.

Further, when there are a plurality of foreground applications, the first target refresh rate determining module is configured to determine the target refresh rate of the display screen according to respective application attributes and respective set refresh rates of the plurality of foreground applications, in which the application attribute of each foreground application includes an application priority or an application type.

Further, the first target refresh rate determining module is configured to: obtain the preset refresh rate corresponding to each of the at least one foreground applications in the whitelist and a current performance parameter of the mobile terminal, in which the performance parameter includes at least one of an electric quantity, a occupied memory and temperature of the mobile terminal, a frequency of a central processor, a load of the central processer, a frequency of an image processor and a load of the image processor; and determine the target refresh rate of the display screen according to the preset refresh rate corresponding to each of the at least one foreground applications and the current performance parameter of the mobile terminal.

Further, the device includes a third target refresh rate determining module. The third target refresh rate determining module is configured to determine the target refresh rate of the display screen as a second preset value when it is determined that any of the at least one foreground application running currently is not in the whitelist.

With the device for controlling a refresh rate of a mobile terminal according to the embodiments of the present disclosure, the foreground application running currently is detected; when the foreground application is in the whitelist, the preset refresh rate corresponding to the foreground application in the whitelist is obtained, and the target refresh rate of the display screen of the mobile terminal is determined according to the preset refresh rate corresponding to the foreground application, in which the operation mode of the display screen is the command mode; and the display screen is controlled by the display controller to read the display frame data to be displayed from the frame buffer unit of the display screen at the same frequency as the target refresh rate and to display the display frame data. In this way, the refresh rate of the display screen of the mobile terminal may be controlled reasonably.

Figure 6:
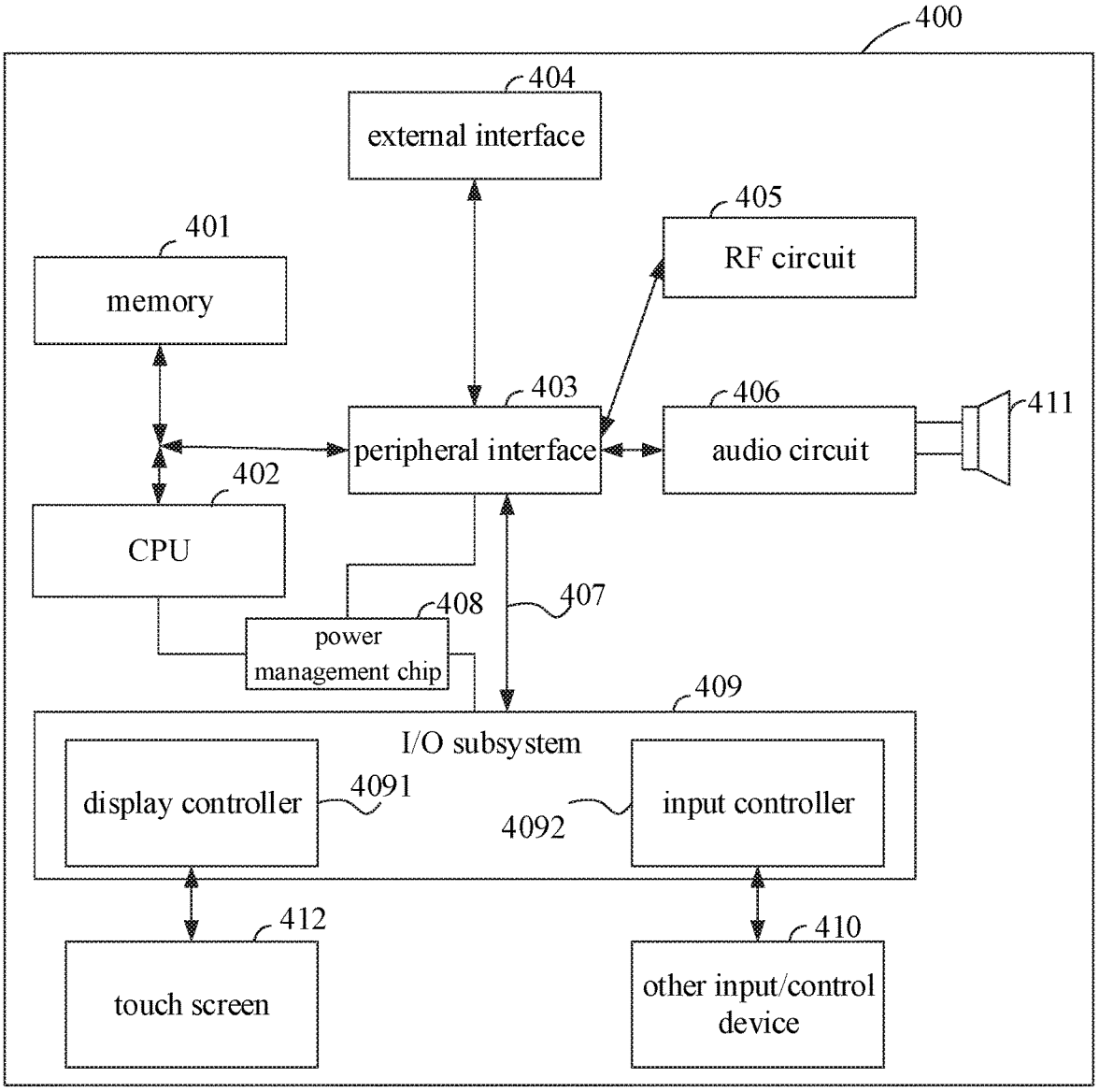
FIG. 6 is a block diagram illustrating a mobile terminal according to an embodiment of the present disclosure.

FIG. 6 is a block diagram illustrating a mobile terminal according to an embodiment of the present disclosure. The mobile terminal may include the device for controlling a refresh rate of a mobile terminal provided in any above embodiment of the present disclosure. As illustrated in FIG.

6, the mobile terminal may include a memory 401, a central processing unit (CPU for short) 402 (also referred to as a processor). The memory 401 is configured to store executable program codes. The processor 402 is configured to run a program corresponding to the executable program codes by reading the executable program codes stored in the memory 401 so as to perform acts of: determining that each of at least one foreground application running currently is in a whitelist including preset applications; obtaining a preset refresh rate corresponding to each of the at least one foreground applications in the whitelist, and determining a target refresh rate of a display screen of the mobile terminal according to the preset refresh rate corresponding to each of the at least one foreground applications, in which an operation mode of the display screen is a command mode; and controlling the display screen by a display controller to read display frame data to be displayed from a frame buffer unit of the display screen at the same frequency as the target refresh rate and to display the display frame data.

The mobile terminal also includes a peripheral interface 403, an RF (radio frequency) circuit 405, an audio circuit 406, a loudspeaker 411, a power management chip 408, an input/output (I/O) subsystem 409, a touch screen (display screen) 412, other input/control devices 410 and an external interface 404. These components may communicate with each other via one or more communication buses or signal lines 407.

It should be understood that the illustrated mobile terminal 400 is only one example and the mobile terminal 400 may have more or fewer components than illustrated, may combine two or more components, or have a different component configuration. The various components illustrated may be implemented in hardware, software, or a combination of hardware and software, such as one or more signal processing and/or specific integrated circuits.

The mobile terminal for controlling the refresh rate provided in the embodiment will be described in detail below, and the mobile terminal takes a mobile phone as an example.

The memory 401 may be accessed by the CPU 402, the peripheral interface 403, etc. The memory 401 may include a static random access memory, or a nonvolatile random access memory, such as one or more disk storage devices, flash memory devices, or other volatile solid state memory devices.

The peripheral interface 403 may connect input and output peripherals of the device to the CPU 402 and the memory 401.

The I/O subsystem 409 may connect the input and output peripherals on the device, such as the touch screen 412 and other input/control devices 410, to the peripheral interface 403. The I/O subsystem 409 may include a display controller 4091 and one or more input controllers 4092 for controlling other input/control devices 410. The one or more input controllers 4092 may receive electrical signals from other input/control devices 410 or send electrical signals to other input/control devices 410. Other input/control devices 410 may include physical buttons (pushing buttons, rocker buttons, etc.), a dial pad, a slide switch, a joystick, a click wheel. It is to be noted that the input controller 4092 may be connected to any of the following: a keyboard, an infrared port, a USB interface, and a pointing device such as a mouse.

The touch screen 412 is an input interface and an output interface between a user terminal and a user, which displays a visual output to the user, in which the visual output may include graphs, text, icons, videos, and the like.

The display controller 4091 in the I/O subsystem 409 receives electrical signals from the touch screen 412 or sends electrical signals to the touch screen 412. The touch screen 412 detects touches thereon. The display controller 4091 converts the detected touch into interaction with a user interface object displayed on the touch screen 412, i.e. enables human-computer interaction. The user interface object displayed on the touch screen 412 may be an icon of a running game icon, an icon for connecting to corresponding network. It is to be noted that, the device may also include a light mouse, which is a touch-sensitive surface that does not exhibit the visual output, or an extension of a touch-sensitive surface formed by the touch screen.

The RF circuit 405 is mainly configured to establish communication between the mobile phone and a wireless network (i.e., a network side) and realizes data receiving and sending of the mobile phone and the wireless network, such as sending and receiving short messages, e-mail and the like. In detail, the RF circuit 405 receives and transmits an RF signal, which is also referred to as an electromagnetic signal. The RF circuit 405 converts an electrical signal into an electromagnetic signal or converts an electromagnetic signal into an electrical signal, and communicates with the communication network and other devices through the electromagnetic signal. The RF circuit 405 may include a known circuit for performing these functions, which may include but be limited to, an antenna system, an RF transceiver, one or more amplifiers, a tuner, one or more oscillators, a digital signal processor, a CODEC (COder-DECoder) chip group, a subscriber identity module (SIM for short), and the like.

The audio circuit 406 is mainly configured to receive audio data from the peripheral interface 403, to convert the audio data into an electrical signal, and to transmit the electrical signal to the loudspeaker 411.

The loudspeaker 411 is configured to restore a voice signal received by the mobile phone from the wireless network through the RF circuit 405 to sound and to play the sound to the user.

The power management chip 408 is configured to power the hardware to which the CPU 402, the I/O subsystem and the peripheral interface 403 are connected.

The above-described mobile terminal may perform the method provided by any one of the embodiments of the present disclosure and have function modules for performing the corresponding method. The foreground application running currently is detected. When the foreground application is in the whitelist, the preset refresh rate corresponding to the foreground application is obtained from the whitelist, and the target refresh rate of the display screen of the mobile terminal is determined according to the preset refresh rate corresponding to the foreground application, in which the operation mode of the display screen is the command mode. The display screen is controlled by the display controller to read the display frame data to be displayed from the frame buffer unit of the display screen at the same frequency as the target refresh rate and to display the display frame data. In this way, the refresh rate of the display screen of the mobile terminal may be controlled reasonably.

The foregoing is only a preferred embodiment of the present disclosure and technical principles employed. The present disclosure is not limited to the specific embodiments described herein. Various obvious changes, readjustments and substitutions that can be made by those skilled in the art are not departed from the scope of the present disclosure. Thus, while the present disclosure has been described in more detail by way of the above examples, the present disclosure is not limited to the above embodiments, and may include more and more equivalent embodiments without departing from the inventive concept, and the present disclosure is determined by the scope of the claims.

What is claimed is:

1. A method for controlling a refresh rate of a mobile terminal, comprising:

determining that each of at least one foreground applications running currently is in a whitelist comprising preset applications;

obtaining a preset refresh rate corresponding to each of the at least one foreground applications in the whitelist and a current performance parameter of the mobile terminal, wherein the performance parameter comprises at least one of an occupied memory and temperature of the mobile terminal, a frequency of a central processor, a load of the central processor, a frequency of an image processor and a load of the image processor;

comparing a ratio of the current performance parameter to a preset maximum performance parameter with a preset ratio to acquire a comparison result;

determining, according to the comparison result, a target refresh rate of a display screen of the mobile terminal based on at least one of the preset refresh rate corresponding to each of the at least one foreground applications and a preset percentage value, wherein an operation mode of the display screen is a command mode; and controlling the display screen by a display controller to read display frame data to be displayed from a frame buffer unit of the display screen at a frequency same as the target refresh rate and to display the display frame data, wherein, when there are a plurality of foreground applications running currently, determining the target refresh rate of the display screen of the mobile terminal according to the set refresh rate corresponding to each of the at least one foreground applications comprises: determining the target refresh rate of the display screen according to respective application attributes and respective preset refresh rates of the plurality of foreground applications, wherein the application attribute of each foreground application comprises an application priority or an application type, determining the target refresh rate of the display screen according to respective application attributes and respective preset refresh rates of the plurality of foreground applications comprises: determining the target refresh rate of the display screen as the preset refresh rate corresponding to the foreground application with the highest application priority.

2. The method according to claim 1, wherein determining that each of at least one foreground application running currently is in a whitelist comprising preset applications comprises:

detecting whether a current display frame to be displayed of the foreground application is same with a preset number of previous continuous display frames; and when it is detected that the current display frame to be displayed is different from the preset number of previous continuous display frames, determining that the foreground application running currently is in the whitelist.

3. The method according to claim 2, further comprising:

when it is detected that the current display frame to be displayed is same with the preset number of previous continuous display frames, determining the target refresh rate of the display screen as a first preset value, wherein the first preset value is less than a preset maximum refresh rate of the display screen.

4. The method according to claim 1, wherein when there is one foreground application running currently, determining the target refresh rate of the display screen of the mobile terminal according to the preset refresh rate corresponding to each of the at least one foreground applications comprises:

determining the target refresh rate of the display screen as the preset refresh rate corresponding to the foreground application.

5. The method according to claim 1, further comprising:

when it is determined that any one of the at least one foreground applications running currently is not in the whitelist, determining the target refresh rate of the display screen as a second preset value.

6. The method according to claim 1, further comprising:

determining that a render frame rate of the foreground application is greater than the target refresh rate; and setting the render frame rate of the foreground application to be same as the target refresh rate.

7. A device for controlling a refresh rate of a mobile terminal, comprising:

a non-transitory computer-readable medium comprising computer-executable instructions stored thereon; and an instruction execution system configured by the instructions to implement at least one act of:

determining that each of at least one foreground applications running currently is in a whitelist comprising preset applications;

obtaining a preset refresh rate corresponding to each of the at least one foreground applications in the whitelist and a current performance parameter of the mobile terminal, wherein the performance parameter comprises at least one of an occupied memory and temperature of the mobile terminal, a frequency of a central processor, a load of the central processor, a frequency of an image processor and a load of the image processor;

comparing a ratio of the current performance parameter to a preset maximum performance parameter with a preset ratio to acquire a comparison result;

determining, according to the comparison result, a target refresh rate of a display screen of the mobile terminal based on at least one of the preset refresh rate corresponding to each of the at least one foreground applications and a preset percentage value, wherein an operation mode of the display screen is a command mode; and controlling the display screen by a display controller to read display frame data to be displayed from a frame buffer unit of the display screen at a frequency same as the target refresh rate and to display the display frame data, wherein, when there are a plurality of foreground applications, the instruction execution system configured by the instructions to implement at least one act of:

determining the target refresh rate of the display screen according to respective application attributes and respective preset refresh rates of the plurality of foreground applications, wherein the application attribute of each foreground application comprises an application priority or an application type, wherein the instruction execution system configured by the instructions to implement at least one act of:

determining the target refresh rate of the display screen as the preset refresh rate corresponding to the foreground application with the highest application priority.

8. The device according to claim 7, wherein the instruction execution system configured by the instructions to implement at least one act of:

detecting whether a current display frame to be displayed of the foreground application is same with a preset number of previous continuous display frames; and when it is detected that the current display frame to be displayed is different from the preset number of previous continuous display frames, determining that the foreground application running currently is in the whitelist.

9. The device according to claim 8, wherein the instruction execution system configured by the instructions to implement at least one act of:

determining the target refresh rate of the display screen as a first preset value when it is detected that the current display frame to be displayed is same with the preset number of previous continuous display frames, wherein the first preset value is less than a preset maximum refresh rate of the display screen.

10. The device according to claim 7, wherein when there is one foreground application, the instruction execution system configured by the instructions to implement at least one act of:

determining the target refresh rate of the display screen as the preset refresh rate corresponding to the foreground application.

11. The device according to claim 7, wherein the instruction execution system configured by the instructions to implement at least one act of:

determining the target refresh rate of the display screen as a second preset value when it is determined that any one of the at least one foreground applications running currently is not in the whitelist.

12. The device according to claim 7, wherein the instruction execution system configured by the instructions to implement at least one act of:

determining that a render frame rate of the foreground application is greater than the target refresh rate; and setting the render frame rate of the foreground application to be same as the target refresh rate.

13. A mobile terminal, comprising a memory, a processor, a display screen and a display controller, wherein the display screen has a frame buffer unit;

the memory is configured to store executable program codes;

the processor is configured to run a program corresponding to executable program codes by reading the executable program codes stored in the memory, to perform the following operations:

determining that each of at least one foreground application running currently is in a whitelist comprising preset applications; and obtaining a preset refresh rate corresponding to each of the at least one foreground applications in the whitelist and a current performance parameter of the mobile terminal, wherein the performance parameter comprises at least one of an occupied memory and temperature of the mobile terminal, a frequency of a central processor, a load of the central processor, a frequency of an image processor and a load of the image processor;

comparing a ratio of the current performance parameter to a preset maximum performance parameter with a preset ratio to acquire a comparison result;

determining, according to the comparison result, a target refresh rate of a display screen of the mobile terminal based on at least one of the preset refresh rate corresponding to each of the at least one foreground applications and a preset percentage value, wherein an operation mode of the display screen is a command mode;

the display controller is configured to control the display screen to read display frame data to be displayed from the frame buffer unit of the display screen at a frequency same as the target refresh rate and to display the display frame data, wherein, when there are a plurality of foreground applications running currently, determining the target refresh rate of the display screen of the mobile terminal according to the set refresh rate corresponding to each of the at least one foreground applications comprises:

determining the target refresh rate of the display screen according to respective application attributes and respective preset refresh rates of the plurality of foreground applications, wherein the application attribute of each foreground application comprises an application priority or an application type, wherein determining the target refresh rate of the display screen according to respective application attributes and respective preset refresh rates of the plurality of foreground applications comprises:

determining the target refresh rate of the display screen as the preset refresh rate corresponding to the foreground application with the highest application priority.

* * * * *